US007387992B2

(12) United States Patent
Hsu et al.

(10) Patent No.: US 7,387,992 B2
(45) Date of Patent: Jun. 17, 2008

(54) LAUNDRY DETERGENT WITH POLYAMINE MONO-ANIONIC SURFACTANT

(75) Inventors: Feng-Lung Gordon Hsu, Tenafly, NJ (US); Shui-Ping Zhu, New Milford, NJ (US); Mei Shi, Ridgewood, NY (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 152 days.

(21) Appl. No.: 11/080,876

(22) Filed: Mar. 15, 2005

(65) Prior Publication Data

US 2006/0211596 A1 Sep. 21, 2006

(51) Int. Cl.
*C11D 1/18* (2006.01)

(52) U.S. Cl. ..... 510/494; 510/276; 510/290; 510/351; 510/352; 510/357; 510/536; 510/498; 510/427; 510/426; 510/424

(58) Field of Classification Search ..... 510/276, 510/290, 351, 352, 357, 424, 426, 427, 494, 510/498, 536
See application file for complete search history.

(56) References Cited

U.S. PATENT DOCUMENTS

| | | | | |
|---|---|---|---|---|
| 4,548,744 | A | 10/1985 | Connor | 252/545 |
| 4,597,898 | A | 7/1986 | Vander Meer | 252/529 |
| 4,622,378 | A | 11/1986 | Gosselink | 528/66 |
| 4,664,848 | A | 5/1987 | Oh et al. | 252/547 |
| 5,669,984 | A | 9/1997 | Scheibel et al. | 134/25.2 |
| 6,121,226 | A | 9/2000 | Gosselink et al. | 510/400 |
| 2004/0048767 | A1* | 3/2004 | Price et al. | 510/499 |
| 2004/0077514 | A1* | 4/2004 | Price et al. | 510/311 |
| 2005/0059570 | A1* | 3/2005 | Hsu et al. | 510/424 |
| 2005/0153860 | A1* | 7/2005 | Zhou et al. | 510/392 |
| 2005/0197275 | A1* | 9/2005 | Hsu et al. | 510/445 |

FOREIGN PATENT DOCUMENTS

| | | |
|---|---|---|
| EP | 137 615 | 4/1985 |
| WO | 99/49009 | 9/1999 |
| WO | 00/63334 | 10/2000 |
| WO | 2005/026302 | 3/2005 |
| WO | 2005/078062 | 8/2005 |

OTHER PUBLICATIONS

Co-pending: Hsu et al., U.S. Appl. No. 10/664,374, filed Sep. 17, 2003.
Co-pending: Hsu et al., U.S. Appl. No. 10/664,310, filed Sep. 17, 2003.
Co-pending: Hsu et al., U.S. Appl. No. 10/777,573, filed Feb. 12, 2004.
Co-pending: Hsu et al., U.S. Appl. No. 10/792,426, filed Mar. 3, 2004.
Co-pending: Hsu et al., U.S. Appl. No. 10/791,908, filed Mar. 3, 2004.
PCT International Search Report in a PCT application PCT/EP 2004/009268.
Japanese Abstract, JP 09 0003483—published Jan. 7, 1997.
European Search Report in an EP Application No. EP 06 07 5414.

* cited by examiner

*Primary Examiner*—Charles I Boyer
(74) *Attorney, Agent, or Firm*—Rimma Mitelman

(57) ABSTRACT

A laundry detergent composition comprising from about 0.1% to about 80%, by weight of the composition, of a polyamine mono-anionic surfactant; and a solubiliser; in a defined weight ratio. Also, a process of making the polyamine mono-anionic surfactant and the laundry compositions containing the same.

7 Claims, No Drawings

LAUNDRY DETERGENT WITH POLYAMINE MONO-ANIONIC SURFACTANT

FIELD OF THE INVENTION

The present invention relates to laundry detergent compositions comprising a polyamine mono-anionic surfactant and a solubiliser.

BACKGROUND OF THE INVENTION

Numerous detergent products are available to a consumer. Continuous consumer need exists, however, for improved performance, especially if such can be achieved at the same or lower cost. Specifically, consumers look for improved soil removal, without having to pay a premium for such benefits.

Polyamines, such as tetraethylene pentamine ("TEPA"), are known in petroleum production and refining operations as corrosion inhibitors, demulsifiers, neutralizers, and functional additives.

Laundry applications use modified polyamines. See for instance, WO 00/63334, EP 137 615, U.S. Pat. No. 5,669,984, U.S. Pat. No. 4,664,848, WO 99/49009, U.S. Pat. No. 6,121,226, U.S. Pat. No. 4,622,378, and U.S. Pat. No. 4,597,898. Some of these documents describe detergent compositions which also incorporate anionic surfactants or fatty acids, or anionic surfactant precursors, in the presence also of strong caustic agents which are added to produce anionic surfactants from anionic surfactant acid precursors or fatty acid salts from fatty acids.

The present invention is based at least in part on the discovery that improved soil removal is achieved when polyamine mono-anionic surfactants are combined with a solubiliser within the parameters according to the present invention.

SUMMARY OF THE INVENTION

The present invention includes, in its first aspect, a laundry detergent composition comprising:

(a) from about 0.1% to about 80%, by weight of the composition, of a polyamine mono-anionic surfactant;

(b) from about 0.05% to about 20% of a solubilizer selected from the group consisting of anionic, nonionic, and amphoteric surfactants having an HLB greater than about 10;

(c) wherein the weight ratio of anionic conjugated acid of the polyamine mono-anionic surfactant to the solubilizer, WR, is equal to or greater than R, which is defined by the equation 1:

$$R=0.22N^2-2.23N+6.07 \quad (1)$$

where N is greater than or equal to 2 and is the number of amine groups in polyamine.

In another aspect, the invention includes processes for making the polyamine mono-anionic surfactant and liquid and granular laundry detergents containing the same.

DETAILED DESCRIPTION OF THE INVENTION

The following detailed description and the examples illustrate some of the effects of the inventive compositions. The invention and the claims, however, are not limited thereto.

Except in the operating and comparative examples, or where otherwise explicitly indicated, all numbers in this description indicating amounts of material or conditions of reaction, physical properties of materials and/or use are to be understood as modified by the word "about." All amounts are by weight of the liquid detergent composition, unless otherwise specified.

It should be noted that in specifying any range of concentration, any particular upper concentration can be associated with any particular lower concentration.

For the avoidance of doubt the word "comprising" is intended to mean "including" but not necessarily "consisting of" or "composed of." In other words, the listed steps or options need not be exhaustive.

"Liquid" as used herein means that a continuous phase or predominant part of the composition is liquid and that a composition is flowable at 15° C. and above (i.e., suspended solids may be included). Gels are included in the definition of liquid compositions as used herein.

"HLB" as used herein is an abbreviation of Hydrophilic-Lipophilic Balance for a surfactant. If a surfactant has higher number of HLB, it is more hydrophilic. The HLB values of commercial surfactants are listed in McCutcheon's Handbook Vol. 1 Emulsion and Detergent.

Polyamime Mono-Anionic Surfactant ("PMAS")

The polyamine mono-anionic surfactants obtained in the process herein contain units having the structure formula:

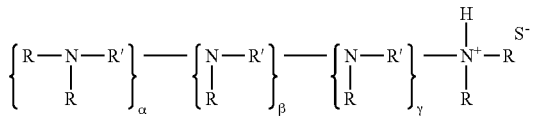

Where R is selected from hydrogen, linear or branched $C_1$-$C_4$ alkyl, $C_7$-$C_{12}$ Alkylaryl, $C_2$-$C_{12}$ alkylene, $C_3$-$C_{12}$ hydroxyalkylene, $C_4$-$C_{12}$ dihydroxyalkylene, $C_8$-$C_{12}$ Dialkylarylene, and

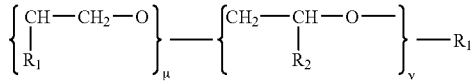

where μ and ν are in the range of 0 to 4 and the sum of μ and ν are between 1 and 4. $R_1$ is selected from hydrogen, linear or branched $C_1$-$C_4$ alkyl, $C_6$-$C_{12}$ Alkylaryl, $C_2$-$C_{12}$ Alkylene, $C_3$-$C_{12}$ hydroxyalkylene, $C_4$-$C_{12}$ dihydroxyalkylene and $C_8$-$C_{12}$ Dialkylarylene;

R2 is selected from R1 and amine oxide;

R' is a linking connecting the nitrogen atoms of the backbone. R' units are selected from $C_2$-$C_{12}$ alkylene, $C_4$-$C_{12}$ alkenylene, $C_3$-$C_{12}$ hydroxyalkylene wherein the hydroxyl moiety may take any position on the R' unit chain except the carbon atoms directly connected to the polyamine backbone nitrogen; $C_4$-$C_{12}$ dihydroxyalkylene wherein the hydroxyl moieties may occupy any two of the carbon atoms of the R' unit chain except those carbon atoms directly connected to the backbone nitrogen. The values of α, β, and γ are between 0 to 10 and the sum of □ and □ is greater than or equal to 1. The total number of amine groups for the present invention is between 2 to 10.

$S^-$ is a conjugated base of anionic surfactant acid ($S^-$—$H^+$) with a HLB number in the range of 2 to 45.

$S^-$ may be expressed as $R_3$–$L^-$

Where $R_3$ is selected from straight or branched $C_6$-$C_{22}$ alkyl, $C_6$-$C_{22}$ Alkylene, $C_6$-$C_{22}$ polyoxyalkylenealkyl, $C_6$-$C_{22}$ polyoxyalkylenacyl, $C_6$-$C_{22}$ alkylaryl, Rosin derivatives, $C_6$-$C_{22}$ N-acylalkyl; $C_6$-$C_{22}$ α-sulfonatedtoalkyl, $C_6$-$C_{22}$ hydroxyalkyl, and $C_6$-$C_{22}$ hydroxyalkylene;

Where $L^-$ is selected from $COO^-$, $SO_3^-$, OSO3$^-$, phosphoric acid, phosphorous acid, amino acids, aromatic carboxylic acid, sugar base acids derived from oxidation of monosaccharides and polysaccharides.

The preferred PMAS according to the present invention is selected from the group consisting of polyamine alkyl benzene sulfonate, polyamine alkyl sulfate, polyamine fatty acid salt, polyamine alkyl polyalkoxy sulfate, and mixtures thereof.

The amount of PMAS is interconnected to the amount of a solubiliser employed in the liquid detergent compositions, but generally is in the range of from 0.1% to 80%, preferably from 1% to 60%, most preferably from 5% to 40%.

Solubiliser

Unlike polyamines, only a few of the PMASs are water soluble, e.g. ethylene diamine-LAS. The majority of PMASs included in the inventive compositions are dispersible (not soluble or not entirely soluble) in water. Hence, the inventive compositions include a solubilizer for PMAS. Even for those PMAS s that are water-soluble, the presence of the solubiliser is highly advantageous, since the solubiliser also adjusts the hydrophophilic/lipophilic balance of the surfactant mix of PMAS and other surfactants to achieve a better soil release. For powder or other non-aqueous compositions, a solubiliser is also needed to ensure PMAS is dissolved in wash water, so that it can contribute its detergency to the laundry cleaning. The solubiliser is selected from the group of anionic, nonionic, and amphoteric surfactants having an HLB higher than 10, preferably higher than 13.

Anionic, nonoionic, and amphoteric surfactants are described in detail hereinbelow. Any of these are suitable to be solubilisers , as long as they have the required HLB. Preferred solubilisers are selected from alcohol ethoxylates (such as C8-C18 Alkane with 5-15 EO groups) and/or alkyl polyethoxy sulfate, due to their ability to help in the formation of the mixed micelles while having superior solubilizing ability.

The amount of the solubiliser depends on the amount of PMAS, and is determined by ensuring that the weight ratio of the anionic conjugated acid of the PMAS to the sum of solubilizers, WR, is equal to or greater than R, which is defined by equation 1:

$$R=0.22N^2-2.23N+6.07 \quad (1)$$

where N is equal to or greater than 2 and is the number of amine groups in polyamine.

Equation 1 limits the maximum weight of the solubiliser. Too much solubiliser destroys the HLB of the surfactant mix of PMAS and other surfactants, resulting in poorer soil release to achieve a better soil release. Too little solubiliser results in poor solubility of PMAS and thus, poor detergency. Thus, the total weight of the solubiliser (WS) is preferably also greater than or equal to S defined by equation (2), as well as falling within the boundaries of equation (1).

$$S=(0.06\ N-0.12)W \quad (2)$$

where N is greater than or equal to 2 and is the number of amine groups in polyamine and W is the weight of the polyamine mono-anionic surfactant.

Generally, the amount of solubiliser is from 0.05 to 20% by weight of the composition, preferably from 0.05 to 10%, most preferably from 0.1 to 5%, as long as the amount satisfies equation 1 and preferably satisfies Process of Making PMAS and Liquid Compositions The composition is preferably prepared by contacting a polyamine and a conjugate acid of an anionic surfactant in the presence of a liquid carrier, preferably water. For a composition comprised of both PMAS and other mono-anionic surfactants (e.g., LAS, PAS, LES, fatty acid soap) the contacting of conjugate acid and polyamines and bases other than polyamines may be in any order. The amounts of polyamine should be equal to or greater than the amount of the molar equivalent of the conjugate acid, otherwise, the product would not all be PMAS and a small amount of polyanionic ammonium surfactant (PAAS) would be formed. In general, PAAS has a high degree of hydrophobicity and lower solubility in comparison to PMAS. It is highly desirable to use PMAS in a detergent composition that requires a smaller amount of solubiliser. After the formation of PMAS, the composition should not be contacted with any strong bases to prevent the destruction of PMAS. On the other hand, the mere physical mixture of a polyamine with an anionic surfactant salt, e.g. Na-LAS, can generate only a negligible amount of PMAS, if at all, and the soil removal benefits would be lower in the comparison to the PMAS prepared by the aforementioned process.

If PMAS and other salts such as anionic surfactants and/or builder salts are co-prepared, then the amount of bases other than polyamine has to equal to or less than 1:1 stoichiometric amount of the conjugated acids that form builder salts and/or anionic surfactants excluding PMAS. The excess bases other than polyamine prevent the formation of PMAS.

If the composition also contains other surfactants, solubilizers, hydrotropes, builders and buffering agents; these ingredients may be added before, during or after the contacting of a polyamine and a conjugate acid. Nevertheless, in-situ preparation of salts, such as sodium citrate, by reacting the acid with bases, e.g. NaOH or KOH, is preferably prepared before the forming of PMAS. For certain ingredients, which are acid sensitive, such as alkyl ether sulfate, it is preferably added after the formation of PMAS. As is well known in the art, minor ingredients such as fragrance, enzyme, functional polymers, bleach system, colorant, fluorescent whitening agent, and preservatives are preferably post-dosed at the end of preparation.

A typical composition may be prepared by first preparing a main mix by mixing water, 70% sorbitol solution, borax, propylene glycol, sodium citrate. After borax is dissolved under moderate agitation, a polyamine, e.g. TEPA (tetraethylenepentamine) is added to the main mix. Anionic surfactant acids, including fatty acid, are then added to the main mix. Mixing is continued until both acids are fully dispersed and consumed. Nonionic surfactant may be added before, during or after the addition of anionic surfactant acids. A solubiliser, e.g. alkyl ether sulfate or nonionic surfactant, is then added to the main mix and the mixing is continued so as to form a homogeneous solution. If included, F-dye is then added to the mixture. The mixing is continued until a homogeneous liquid detergent composition is formed.

Process of Making Granules

Any known granulation process may be used for preparing PMAS granules. One of the preferred route is to charge solid ingredients, e.g. carbonate, bicarbonate, percarbonate, zeolite, silicate, and other optional solid ingredients, e.g. solid acid, to a high shear mixer, followed by PMAS and a solubilizer. The ingredients are granulated at a high shear until the desired particle size is obtained. In general, it takes about 0.5 to 5 minutes depending on the shear and the liquid binder to solid ratio. A layering agent, e.g. zeolite, may be added to enhance the flowability and reduce the tendency of caking. Other ingredients, e.g. enzyme granules, whitening agent, perfume, may be post dosed.

The other preferred route is to first charge solid ingredients to a low to medium shear mixer, such as a rolling drum granulator, a fluidized bed granulator, or a pan granulator. PMAS and the solubiliser is then sprayed-on or dripped onto the powder while the drum or pan is rotating or the bed is fluidized. A layering agent, e.g. zeolite, may be added to enhance the flowability and reduce the tendency of caking. Other ingredients, e.g. enzyme granules, whitening agent, perfume, may be post-dosed.

Optional Ingredients

The inventive compositions may include non-neutralized polyamine and alkyl benzene sulfonate salts and/or alkyl sulfate salts and/or fatty acid salts, in addition to the PMAS surfactant of the present invention.

The inventive compositions may be liquid or solid. The preferred compositions are liquid and, especially aqueous, since such compositions may benefit the most from the inventive PMAS/solubiliser combination. A liquid carrier is a liquid at and above 15° C., preferably above 10° C., and most preferably above 0° C.

A typical liquid carrier in the inventive liquid compositions is aqueous—that is, the inventive compositions comprise generally from 20% to 99.9%, preferably from 40% to 80%, most preferably, to achieve optimum cost and ease of manufacturing, from 50% to 70% of water. Other liquid components, such as solvents, surfactants, liquid organic matters including organic bases, and their mixtures can form the liquid carrier.

Solvents that may be present include but are not limited to alcohols, surfactant, fatty alcohol ethoxylated sulfate or surfactant mixes, alkanol amine, polyamine, other polar or non-polar solvents, and mixtures thereof. The liquid carrier is employed in an amount of from 20% to 99.9%.

The pH of the inventive liquid compositions is generally equal to or greater than 5.0, preferably greater than 7.0, most preferably greater than 8.5. When the pH of the inventive composition is too low, a portion of anionic surfactants remain in their conjugated acid form, rather than forming a PMAS surfactant. Conjugated acids are poor in detergency or in some cases they are classified as a soil (e.g., fatty acids).

The pH of the inventive compositions is generally in the range of from 5 to 12, preferably greater than 7.0, in order to attain maximum efficacy at a minimum cost.

Fluorescent Whitening Agent ("FWA")

The inventive compositions preferably include from 0.01% to 2.0%, more preferably from 0.05% to 1.0%, most preferably from 0.05% to 0.5% of a fluorescer. Examples of suitable fluorescers include but are not limited to derivative of stilbene, pyrazoline, coumarin, carboxylic acid, methinecyamines, dibenzothiophene-5,5-dioxide azoles, 5-, and 6-membered-ring heterocycles, triazole and benzidine sulfone compositions, especially sulfonated substituted triazinyl stilbene, sulfonated naphthotriazole stilbene, benzidene sulfone, etc. Most preferred are UV/stable brighteners (for compositions visible in transparent containers), such as distyrylbiphenyl derivatives (Tinopal® CBS-X).

Additional Surfactant

The compositions of the invention may, but do not have to contain additional surface active agents in addition to PMAS and the solubiliser. Additional surfactants are selected from the group consisting of anionic, nonionic, cationic, ampholytic and zwitterionic surfactants or mixtures thereof. It should be noted that if the surfactant satisfies the HLB requirement for the solubiliser as discussed hereinabove, its amount is limited by equation 1. Surfactants outside the HLB range for solubilisers may be present in other amounts. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) and nitrogen based bases (e.g. mono-amines and polyamines) salts of water soluble higher alkyl aryl sulfonates, alkyl sulfonates, alkyl sulfates and the alkyl poly ether sulfates. They may also include fatty acid or fatty acid soaps. One of the preferred groups of mono-anionic surface active agents are the alkali metal, ammonium or alkanolamine salts of higher alkyl aryl sulfonates and alkali metal, ammonium or alkanolamine salts of higher alkyl sulfates or the mono-anionic polyamine salts. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine sulfate can be used in admixture with the alkylbenzene sulfonate in an amount of 0 to 70%, preferably 5 to 50% by weight.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 1 to 8, preferably 2 to 6, and more preferably 2 to 4; and M is an alkali metal, such as sodium and potassium, an ammonium cation or polyamine. The sodium and potassium salts, and polyaimines are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic Surfactant

Nonionic surfactants which can be used with the invention, alone or in combination with other surfactants are described below.

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929, incorporated by reference herein.

Usually, the nonionic surfactants are polyalkoxylated lipophiles wherein the desired hydrophile-lipophile balance is obtained from addition of a hydrophilic poly-alkoxy group to a lipophilic moiety. A preferred class of nonionic detergent is the alkoxylated alkanols wherein the alkanol is of 9 to 20 carbon atoms and wherein the number of moles of alkylene oxide (of 2 or 3 carbon atoms) is from 3 to 20. Of such materials it is preferred to employ those wherein the alkanol is a fatty alcohol of 9 to 11 or 12 to 15 carbon atoms and which contain from 5 to 9 or 5 to 12 alkoxy groups per mole. Also preferred is paraffin—based alcohol (e.g. nonionics from Huntsman or Sassol).

Exemplary of such compounds are those wherein the alkanol is of 10 to 15 carbon atoms and which contain about 5 to 12 ethylene oxide groups per mole, e.g. Neodol® 25-9 and Neodol® 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1$^{(R)}$ series of surfactants manufactured by Shell Chemical Company.

Other useful nonionics are represented by the commercially well known class of nonionics sold under the trademark Plurafac® by BASF. The Plurafacs® are the reaction products of a higher linear alcohol and a mixture of ethylene and propylene oxides, containing a mixed chain of ethylene oxide and propylene oxide, terminated by a hydroxyl group. Examples include $C_{13}$-$C_{15}$ fatty alcohol condensed with 6 moles ethylene oxide and 3 moles propylene oxide, $C_{13}$-$C_{15}$ fatty alcohol condensed with 7 moles propylene oxide and 4 moles ethylene oxide, $C_{13}$-$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol® or Neodo® trademark: Dobanol® 91-5 is an ethoxylated $C_9$-$C_{11}$ fatty alcohol with an average of 5 moles ethylene oxide and Dobanol® 25-7 is an ethoxylated $C_{12}$-$C_{15}$ fatty alcohol with an average of 7 moles ethylene oxide per mole of fatty alcohol.

In the compositions of this invention, preferred nonionic surfactants include the $C_{12}$-$C_{15}$ primary fatty alcohols with relatively narrow contents of ethylene oxide in the range of from about 6 to 9 moles, and the $C_9$ to $C_{11}$ fatty alcohols ethoxylated with about 5-6 moles ethylene oxide.

Another class of nonionic surfactants which can be used in accordance with this invention are glycoside surfactants. Glycoside surfactants suitable for use in accordance with the present invention include those of the formula:

$$RO—(R^2O)_y—(Z)_x$$

wherein R is a monovalent organic radical containing from about 6 to about 30 (preferably from about 8 to about 18) carbon atoms; $R^2$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4

(preferably from about 1½ to 4). Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Generally, nonionics would comprise 0-75% by wt., preferably 5 to 50%, more preferably 5 to 25% by wt. of the composition. Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all. Amphoteric Surfactants Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino) propane-1-sulfonate, sodium 2-(dodecylamino) ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis (2-hydroxyethyl)-2-sulfato-3-dodecoxypropylamine.
Sodium 3-(dodecylamino) propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of additional surfactant used may vary from 1 to 85% by weight, preferably 10 to 50% by weight.

As noted the preferred surfactant systems of the invention are mixtures of anionic and nonionic surfactants.

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1.

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetatesand N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1- hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, imino disuccinate, salts of polymers of itaconic acid and maleic acid, tartrate monosuccinate, tartrate disuccinate and mixtures thereof.

Sodium citrate is particularly preferred, to optimize the function vs. cost, in an amount of from 0 to 15%, preferably from 1 to 10%.

Certain zeolites or aluminosilicates can be used. One such aluminosilicate which is useful in the compositions of the invention is an amorphous water-insoluble hydrated compound of the formula $Na_x,(_yAlO_2.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

One or more enzymes as described in detail below, may be used in the compositions of the invention.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. lipolyticum NRRL B-3673.

An example of a fungal lipase as defined above is the lipase ex *Humicola lanuginosa*, available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa*and expressing this gene in *Aspergillus oryzae*, commercially available from Novozymes under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1-10, more preferably 0.5-7, most preferably 1-2 g/liter.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase®, Savinase®, Esperase®, all of Novozymes; Maxatase® and Maxacal® of Gist-Brocades; Kazusase® of Showa Denko. The amount of proteolytic enzyme, included in the composition, ranges from 0.05-50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system, especially for liquid compositions, is the pH jump system such as is taught in U.S. Pat. No. 5,089,163 to Aronson et al., hereby incorporated by reference into the subject application. A pH jump heavy duty liquid is a composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax $10H_2O$/ polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Alkalinity buffers which may be added to the compositions of the invention include monoethanolamine, triethanolamine, borax and the like.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401, 413 to Marriott and British Patent No. 461,221 to Marriott and Guam.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Anti-foam agents, e.g. silicon compounds, such as Silicane® L 7604, can also be added in small effective amounts, although it should be noted that the inventive compositions are low-foaming.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, additional soil release polymers and cationic softening agents may be used.

Preferably, if the composition is liquid it is a colored composition packaged in the transparent/translucent ("see-through") container. Preferred containers are transparent/translucent bottles. "Transparent" as used herein includes both transparent and translucent and means that a composition, or a package according to the invention preferably has a transmittance of more than 25%, more preferably more than 30%, most preferably more than 40%, optimally more than 50% in the visible part of the spectrum (approx. 410-800 nm). Alternatively, absorbency may be measured as less than 0.6 (approximately equivalent to 25% transmitting) or by having transmittance greater than 25% wherein % transmittance equals: $1/10^{absorbancy \times 100}$%. For purposes of the invention, as long as one wavelength in the visible light range has greater than 25% transmittance, it is considered to be transparent/translucent.

Transparent bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The preferred liquid inventive compositions which are packaged into transparent containers include an opacifier to impart a pleasing appearance to the product. The inclusion of the opacifier is particularly beneficial when the liquid detergent compositions in the transparent containers are in colored. The preferred opacifier is styrene/acrylic co-polymer. The opacifier is employed in amount of from 0.0001 to 1%, preferably from 0.0001 to 0.2%, most preferably from 0.0001 to 0.04%.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling.

For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

Method of Using Compositions

In use, the indicated quantity of the composition (generally in the range from 50 to 200 ml or 20 to 100 grams) depending on the size of the laundry load, the size and type of the washing machine, is added to the washing machine which also contains water and the soiled laundry.

The following specific examples further illustrate the invention, but the invention is not limited thereto.

Particulate Soil Removal Evaluation (Soil Release Index ("SRI") measurement)): Evaluation for removal of particulate soil was conducted from a single wash in warm water at 90° F. A split stain methodology was used and a benchmark detergent was also tested for the purpose of comparison. The fabric used in test was polyester. A Hunter reflection meter was used to measure L, a, and b. These values were taken to calculate SRI Index values using the following equation:

$$SRI=100-[(L_f-L_i)^2+(a_f-a_i)^2+(b_f-b_i)^2]^{1/2},$$

where subscripts of "i" and "f" represent the initial and final stages of wash.

The abbreviations in the Examples denote the following:

TEPA: Tetraethylenepentamine

NA-LAS: Sodium alkylbenzenesufonate

LAS: alkylbenzenesulfonic acid

Na-LES: Sodium alkylpolyethoxysulfate

EDA: Ethylene diamine

DETA: Diethylenetriamine

Neodol® 25-7: C12-15 7EO alcohol ethoxylate
Neodol® 25-9: C12-15 9EO alcohol ethoxylate

EXAMPLES 1-6 AND COMPARATIVE EXAMPLES A-E

Examples 1-6 (within the scope of present invention) and Comparative Examples A-E (which are outside the scope of the invention). These formulations were prepared by first mixing LAS and Neodol® 25-9 to form a clear solution as Premix 1. Polyamines were dispersed into water in a main tank, followed by adding the premix 1. After neutralization, other ingredients were added. Polyamine was replaced by NaOH solution for Comparative Example A, so PMAS was not formed at all in Example A. Examples B-E had a weight ratio of the solubiliser to the conjugated acid of PMAS outside the scope of the invention. The results that were obtained are summarised in Table 1.

TABLE 1

| | EXAMPLE | | | | | | | | | | |
|---|---|---|---|---|---|---|---|---|---|---|---|
| | 1 | 2 | 3 | 4 | 5 | 6 | A | B | C | D | E |
| LAS | 10.0 | 10.0 | 15.0 | 7.6 | 11.0 | 13.0 | 10.0 | 5.0 | 10.0 | 6.7 | 5.0 |
| TEPA | 6.3 | | | 4.78 | 6.92 | 8.14 | | 3.1 | | | |
| DETA | | 4.4 | | | | | | | 3.4 | | |
| EDA | | | 2.0 | | | | | | | 1.3 | 1.0 |
| NaOH (50%) | | | | | | | 2.7 | | | | |
| Neodol ®25-7 | | | | 12.4 | 9.0 | 7.0 | | 15.0 | | 13.3 | 15.0 |
| Neodol ® 25-9 | 10 | 10 | 5 | | | | 10.00 | | 10.00 | | |
| Miscellaneous | 0.5 | 0.5 | 0.5 | 0.5 | 0.5 | 0.5 | 0.50 | 0.50 | 0.50 | 0.50 | 0.50 |
| water | To 100 | To 100 | To 100 | To 100 | To 100 | To 100 | To 100 | To 100 | To 100 | To 100 | To 100 |
| LAS + Solubilizer | 20.0 | 20.0 | 20.0 | 20.0 | 20.0 | 20.0 | 20.0 | 20.0 | 20.0 | 20.0 | 20.0 |
| SRI | 64.0 | 61.6 | 58.5 | 60.7 | 62.0 | 60.2 | 52.6 | 51.2 | 52.0 | 50.9 | 52.2 |
| N | 5 | 4 | 2 | 5 | 5 | 5 | N/A | 5 | 3 | 2 | 2 |
| R | 0.42 | 0.67 | 2.49 | 0.42 | 0.42 | 0.42 | N/A | 0.42 | 1.36 | 2.49 | 2.49 |
| WR | 1 | 1 | 3 | 0.61 | 1.23 | 1.84 | N/A | 0.33 | 1 | 0.5 | 0.33 |
| WR >= R | Yes | Yes | Yes | Yes | Yes | Yes | N/A | NO | NO | NO | NO |

It can be seen from the results in Table 1 that Examples 1-6 which had WR values greater than their corresponding R values, performed substantially better at soil removal than Comparative Example A (which contained no PMAS) and also better than Comparative Examples The WR values of Comparative Examples B-E are lower than their corresponding R values and their performance is the same or even poorer than the Comparative Example A, which did not contain any PMAS. Comparative Examples B-E also performed substantially worse at soil removal than Examples 1-6.

EXAMPLE 7 AND COMPARATIVE EXAMPLE F

This study investigated the particulate stain removal of a PMAS-containing powder formulation by comparing Example 7 (within the scope of present invention) and Comparative Example F (outside the scope of the invention). Example 7 formulation consisted of TEPA-LAS, solubilizer and various builders (i.e sodium sulfate, sodium carbonate and sodium bisulfate). Example F had the same compositions except NaOH replaced the polyamine, TEPA, as the neutralizing agent. The powder preparation consisted of an active mix and a dried mix. The active mix was prepared by mixing solubilizer with LAS acid, followed by the addition of a neutralizing agent, TEPA or NaOH. The dried mix was prepared by mixing the builders together. Finally, the active mix and the dry mix were blended until a uniform powder was obtained. The washes were carried out by a Tergometer at 32° C. at dosage of 0.93 g product per liter of water. The formulations that were prepared and the results that were obtained are summarised in Table 2.

TABLE 2

| | Example | |
|---|---|---|
| | 7 | F |
| BNE 7 | 6.7 | 6.7 |
| LAS acid | 8.3 | 8.3 |
| TEPA | 5.0 | 0.0 |
| NaOH (50%) | 0.0 | 2.1 |
| Sodium Carbonate | 15.0 | 15.0 |
| Sodium Bisulfate | 25.0 | 25.0 |
| Sodium Sulfate | 40.0 | 40.0 |

TABLE 2-continued

| | Example | |
|---|---|---|
| | 7 | F |
| SRI | 55.67 | 51.29 |
| N | 5 | N/A |
| R | 0.42 | N/A |
| WR | 0.52 | N/A |
| WR >= R | yes | N/A |

It can be seen from the results in Table 2 that the WR value of Example 7 was greater than its corresponding R value and that Example 7 had better SRI values than Comparative Example F (which contained no PMAS).

It should be understood that the specific forms of the invention herein illustrated and described are intended to be representative only. Changes, including but not limited to those suggested in this specification, may be made in the illustrated embodiments without departing from the clear teachings of the disclosure. Accordingly, reference should be made to the following appended claims in determining the full scope of the invention.

What is claimed is:

1. A laundry detergent composition comprising:

(a) from about 0.1% to about 80%, by weight of the composition, of a polyamine mono-anionic surfactant having the structure formula:

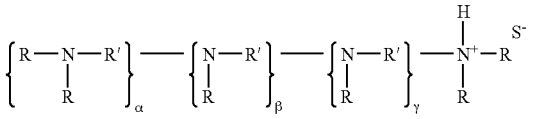

where R is selected from hydrogen, linear or branched $C_1$-$C_4$ alkyl, $C_7$-$C_{12}$ Alkylaryl, $C_2$-$C_{12}$ alkylene, $C_3$-$C_{12}$ hydroxyalkylene, $C_4$-$C_{12}$ dihydroxyalkylene, $C_8$-$C_{12}$ dialkylarylene, and

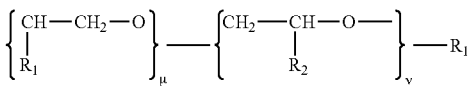

where μ and ν are in the range of 0 to 4 and the sum of μ and ν are between 1 and 4; $R_1$ is selected from hydrogen, linear or branched $C_1$-$C_4$ alkyl, $C_6$-$C_{12}$ alkylaryl, $C_2$-$C_{12}$ alkylene, $C_3$-$C_{12}$ hydroxyalkylene, $C_4$-$C_{12}$ dihydroxyalkylene, $C_8$-$C_{12}$ dialkylarylene;

R2 is selected from R1 and amine oxide;

R' is selected from $C_2$-$C_{12}$ alkylene, $C_4$-$C_{12}$ alkenylene, $C_3$-$C_{12}$ hydroxyalkylene wherein the hydroxyl moiety may take any position on the R' unit chain except the carbon atoms directly connected to the backbone nitrogen; $C_4$-$C_{12}$ dihydroxyalkylene wherein the hydroxyl moieties may occupy any two of the carbon atoms of the R' unit chain except those carbon atoms directly connected to the backbone nitrogen;

the values of α, β, and γ are between 0 to 10 and the sum of α and β is greater than or equal to 1;

$S^-$ is: $R_3$–$L^{31}$ where $R_3$ is selected from straight or branched $C_6$-$C_{22}$ alkyl, $C_6$-$C_{22}$ alkylene, $C_6$-$C_{22}$ polyoxyalkylenalkyl, $C_6$-$C_{22}$ polyoxyalkylenacyl, $C_6$-$C_{22}$ alkylaryl, rosin derivatives, $C_6$-$C_{22}$ N-acylalkyl; $C_6$-$C_{22}$ α-sulfonatedtoalkyl, $C_6$-$C_{22}$ hydroxyalkyl, and $C_6$-$C_{22}$ hydoxyalkylene;

where $L^-$ is selected from $COO^-$, $SO_3^-$, OSO3$^-$, phosphoric acid, phosphorous acid amino acids, aromatic carboxylic acid, sugar base acids derived from oxidation of monosaccharides and polysaccharides;

(b) from about 0.05% to about 2%, of a solubilizer selected from the group consisting of anionic, nonionic, and amphoteric surfactants having an HLB greater than about 10;

(c) wherein the weight ratio of anionic conjugated acid of the polyamine mono-anionic surfactant to the solubilizer, WR, is equal to or greater than R, which is defined by the equation 1:

$$R=0.22N^2-2.23N+6.07 \quad (1)$$

where N is greater than or equal to 2 and is the number of amine groups in polyamine.

2. The composition of claim 1 wherein the polyamine mono-anionic surfactant is selected from the group consisting of polyamine alkyl benzene sulfonate, polyamine alkyl sulfate, polyamine fatty acid salt, polyamine alkyl polyalkoxy sulfate, and mixtures thereof.

3. A method of improving soil removal from soiled garments, the method comprising adding into a laundry washing machine the composition of claim 1.

4. The composition of claim 1 wherein the minimum amount of solubiliser, WS, is equal to or greater than S defined in Equation 2:

$$S=(0.06N-0.12)W \quad (2)$$

where N is greater than or equal to 2 and is the number of amine groups in polyamine and W is the weight of the polyamine mono-anionic surfactant.

5. The composition of claim 1 wherein the HLB value of the solubiliser is greater than about 13.

6. A process of making a liquid laundry detergent composition comprising a polyamine mono-anionic surfactant, having the structure formula:

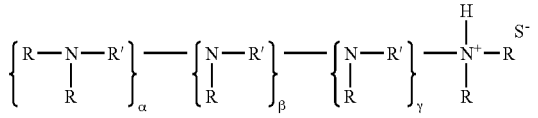

where R is selected from hydrogen, linear or branched $C_1$-$C_4$ alkyl, $C_7$-$C_{12}$ alkylaryl, $C_2$-$C_{12}$ alkylene, $C_3$-$C_{12}$ hydroxyalkylene, $C_4$-$C_{12}$ dihydroxyalkylene, $C_8$-$C_{12}$ dialkylarylene, and

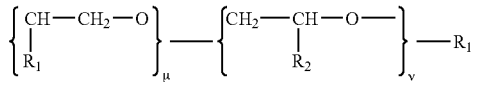

where μ and ν are in the range of 0 to 4 and the sum of μ and ν are between 1and4, $R_1$ is selected from hydrogen, linear or branched $C_1$-$C_4$ alkyl, $C_6$-$C_{12}$ alkylaryl, $C_2$-$C_{12}$ alkylene, $C_3$-$C_{12}$ hydroxyalkylene, $C_4$-$C_{12}$ dihydroxyalkylene, $C_8$-$C_{12}$ dialkylarylene;

R2 is selected from R1 and amine oxide;

R' is selected from $C_2$-$C_{12}$ alkylene, $C_4$-$C_{12}$ alkenylene, $C_3$-$C_{12}$ hydroxyalkylene wherein the hydroxyl moiety may take any position on the R' unit chain except the carbon atoms directly connected to the backbone nitrogen; $C_4$-$C_{12}$ dihydroxyalkylene wherein the hydroxyl moieties may occupy any two of the carbon atoms of the R' unit chain except those carbon atoms directly connected to the backbone nitrogen;

the values of α, β, and γ are between 0 to 10 and the sum of α and β is greater than or equal to 1;

$S^-$ is: $R_3$–$L^-$ where $R_3$ is selected from straight or branched $C_6$-$C_{22}$ alkyl, $C_6$-$C_{22}$ alkylene, $C_6$-$C_{22}$ polyoxyalkylenalkyl, $C_6$-$C_{22}$ polyoxyalkylenacyl, $C_6$-$C_{22}$ alkylaryl, rosin derivatives, $C_6$-$C_{22}$ N-acylalkyl; $C_6$-$C_{22}$ α-sulfonatedtoalkyl, $C_6$-$C_{22}$ hydroxyalkyl, and $C_6$-$C_{22}$ hydoxyalkylene;

where $L^-$ is selected from $COO^-$, $SO_3^-$, OSO3$^-$, phosphoric acid phosphorous acid,. amino acids, aromatic carboxylic acid, sugar base acids derived from oxidation of monosaccharides and polysaccharides;

the process comprising forming the polyamine mono-anionic surfactant by mixing a liquid carrier with:

(1) from about 0.03% to about 85%, by weight of the composition, of a conjugate acid of an anionic surfactant; and (2) a polyamine in the amount about equal to or greater than 1:1 stoichiometric amount of the conjugate acid, (3) wherein the amount of bases other than polyamine is equal to or less than 1:1 stoichiometric amount of the conjugate acids that form builder salts and/or anionic surfactants excluding polyamine mono-anionic surfactant.

7. A process of preparing detergent granules comprising a polyamine mono-anionic surfactant, the process comprising the steps of:

(a) charging solid detergent ingredients into a granulator, (b) adding before or during the granulation a substantially non-aqueous binder comprising:

(1) from about 5% to about 80%, by weight of the binder, of the polyamine mono-anionic surfactant having the structure formula:

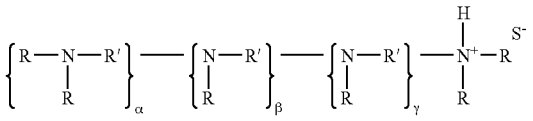

where R is selected from hydrogen, linear or branched $C_1$-$C_4$ alkyl, $C_7$-$C_{12}$ alkylaryl, $C_2$-$C_{12}$ alkylene, $C_3$-$C_{12}$ hydroxyalkylene, $C_4$-$C_{12}$ dihydroxyalkylene, $C_8$-$C_{12}$ dialkylarylene, and

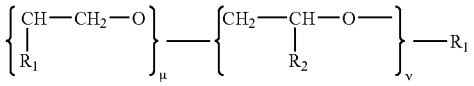

where μ and ν are in the range of 0 to 4 and the sum of μ and ν are between 1and 4, $R_1$ is selected from hydrogen, linear or branched $C_1$-$C_4$ alkyl, $C_6$-$C_{12}$ alkylaryl, $C_2$-$C_{12}$ alkylene, $C_3$-$C_{12}$ hydroxyalkylene, $C_4$-$C_{12}$ dihydroxyalkylene, $C_8$-$C_{12}$ dialkylarylene;

R2 is selected from R1 and amine oxide;

R' is selected from $C_2$-$C_{12}$ alkylene, $C_4$-$C_{12}$ alkenylene, $C_3$-$C_{12}$ hydroxyalkylene wherein the hydroxyl moiety may take any position on the R' unit chain except the carbon atoms directly connected to the backbone nitrogen; $C_4$-$C_{12}$ dihydroxyalkylene wherein the hydroxyl moieties may occupy any two of the carbon atoms of the R' unit chain except those carbon atoms directly connected to the backbone nitrogen;

the values of α, β, and γ are between 0 to 10 and the sum of α and β is greater than or equal to 1;

$S^-$ is: $R_3$–$L^-$ where $R_3$ is selected from straight or branched $C_6$-$C_{22}$ alkyl, $C_6$-$C_{22}$ alkylene, $C_6$-$C_{22}$ polyoxyalkylenalkyl, $C_6$-$C_{22}$ polyoxyalkylenacyl, $C_6$-$C_{22}$ alkylaryl, rosin derivatives, $C_6$-$C_{22}$ N-acylalkyl; $C_6$-$C_{22}$ α-sulfonatedtoalkyl, $C_6$-$C_{22}$ hydroxyalkyl, and $C_6$-$C_{22}$ hydoxyalkylene;

where $L^-$ is selected from $COO^-$, $SO_3^-$, $OSO3^-$, phosphoric acid phosphorous acid,. amino acids, aromatic carboxylic acid, sugar base acids derived from oxidation of monosaccharides and polysaccharides;

(2) from about 95% to about 20%, by weight of the binder, of a substantially non-aqueous solubilizer for the polyame mono-anionic surfactant;

(3) optionally, from about 0% to about 20%, by weight of the binder, of a water-dissolvable/water dispersible liquifiable binder, to form the polyamine mono-anionic surfactant granules, (4) optionally, adding a layering agent and/or post-dosing other minor ingredients.

* * * * *